US005439166A

United States Patent [19]

Focke

[11] Patent Number: 5,439,166

[45] Date of Patent: Aug. 8, 1995

[54] RECLOSABLE PACK MADE FROM PLASTIC FOIL

[75] Inventor: Heinz Focke, Verden, Germany

[73] Assignee: Focke & Co. (GmbH & Co.), Verden, Germany

[21] Appl. No.: 213,764

[22] Filed: Mar. 16, 1994

[30] Foreign Application Priority Data

Mar. 16, 1993 [DE] Germany ..... 43 08 343.9

[51] Int. Cl.[6] ..... B65D 75/08

[52] U.S. Cl. ..... 229/87.05; 229/144

[58] Field of Search ..... 229/138, 141, 144, 3.5 MF, 229/87.05

[56] References Cited

U.S. PATENT DOCUMENTS

| | | | |
|---|---|---|---|
| 3,067,040 | 12/1962 | Hanson . | |
| 3,679,048 | 7/1972 | Fujio | 229/87.05 X |
| 4,290,526 | 9/1981 | Haiss | 229/87.05 X |
| 4,607,786 | 8/1986 | Weaver | 229/138 X |
| 5,121,879 | 6/1992 | Focke et al. | 229/87.05 X |

FOREIGN PATENT DOCUMENTS

| | | | |
|---|---|---|---|
| 392224 | 10/1990 | European Pat. Off. | 229/87.05 |
| 2159659 | 6/1973 | France . | |
| 2029976 | 12/1971 | Germany . | |
| 7539076 | 4/1976 | Germany . | |
| 3324490 | 11/1984 | Germany . | |
| 9109814 | 11/1991 | Germany . | |
| 9209040 | 11/1992 | Germany . | |
| 193444 | 12/1964 | Sweden | 229/87.05 |
| 375979 | 4/1964 | Switzerland . | |

*Primary Examiner*—Stephen J. Castellano
*Assistant Examiner*—Christopher J. McDonald
*Attorney, Agent, or Firm*—Sughrue, Mion, Zinn, Macpeak & Seas

[57] ABSTRACT

The invention relates to a reclosable cuboid pack made from plastic foil, especially for receiving paper handkerchiefs, with a front wall, rear wall, narrow side walls, top wall and bottom wall, the top wall adjoining the rear wall in one piece and being foldable in the direction of the front wall in order to close the pack, and the top wall being connected to the side walls by means of respective inwardly foldable side tabs. According to the invention, provision is made for the side tabs (18) each to have at least one predetermined or prefolded folding line (23, 25, 27) starting from a respective corner point (20) between the rear wall, top wall (16) and side wall.

8 Claims, 3 Drawing Sheets

RECLOSABLE PACK MADE FROM PLASTIC FOIL

BACKGROUND OF THE INVENTION

FIELD OF THE INVENTION

The invention relates to a reclosable pack made from plastic foil, especially for receiving paper handkerchiefs, with a front wall and a rear wall and with folding tabs which, for opening and closing, can be folded along predetermined folding lines.

Plastic foils are some of the packaging materials which are in most frequent use. In particular, plastic foils are used for cuboid soft packs which serve for receiving a stack of folded paper handkerchiefs (DE-U-9109814.9). However, cigarette packs consisting of a multi-layer (laminated) plastic foil are also already known.

One property of plastic foils that is disadvantageous for packaging technique is that, as a result of the material-related restoring forces in plastic foils, constantly recurring folding lines formed merely by folding cannot be achieved. However, these are necessary particularly in those packs which have folding tabs, especially closing tabs, for the multiple opening and reclosing of the pack (DE-U-9109814.9). In such reclosable foil packs, it is necessary for folding tabs to be correctly folded reliably along predetermined folding lines.

SUMMARY OF THE INVENTION

The object on which the invention is based is, therefore, to prepare or treat packaging material having permanent restoring forces, especially plastic foil, in such a way that folding lines are formed in a constantly recurring manner without external action.

To achieve this object, the pack according to the invention is characterized in that regions of the plastic foil which are adjacent to one another in the region of the folding lines are connected permanently to one another, preferably by heat and pressure in the case of a thermoplastic foil.

In the invention, therefore, the plastic foil is treated in the region of the folding line by permanent deformation, in such a way that a stable folding line not influenced by restoring forces is formed. Preferably, for this purpose, strip-like regions of the foil which extend immediately adjacent to the folding line are connected to one another, specifically by heat sealing, by adhesive bonding or in another way. A sealing seam thus obtained is stable for recurring foldings, especially in conjunction with the opening and reclosing of the pack. The sealing seam or the folding line defined by this has some restoring forces in the direction of the folding position.

A foil treated in the way according to the invention can be used especially advantageously for reclosable cuboid packs, in which a top wall serves as a closing tab and is connected to narrow side walls of the pack by means of foldable side tabs. In this construction of a pack, it is important that, during the closing of the closing tab or of the top wall, the side tabs are folded in exactly between the top wall and end face of the pack.

BRIEF DESCRIPTION OF THE DRAWINGS

Further particulars of the invention are explained in more detail below by means of an exemplary embodiment of the pack according to the invention. In the drawing.

DETAILED DESCRIPTION OF THE PREFERRED EMBODIMENTS

Figure 1:
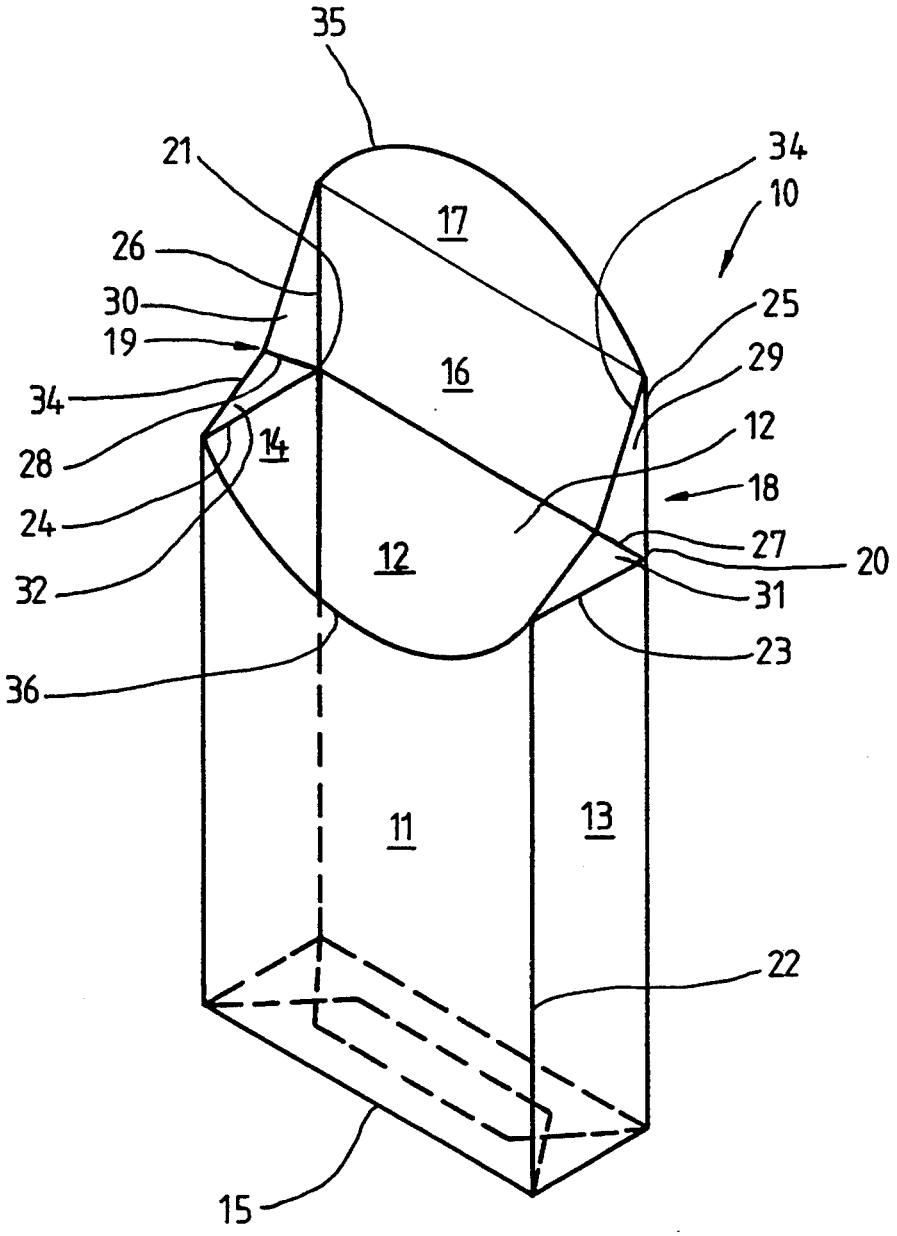
FIG. 1 shows a perspective view of an opened pack.
Figure 2:
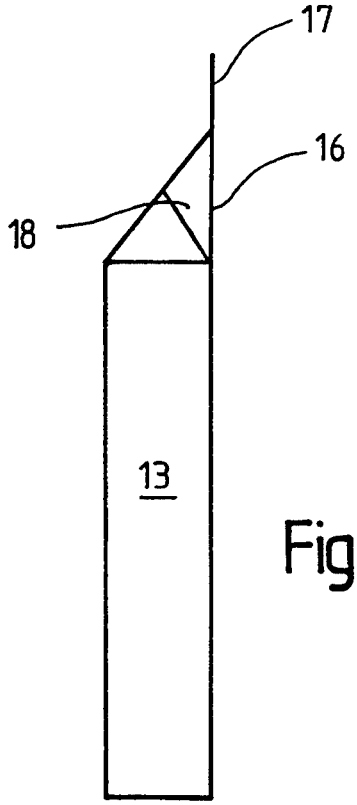
FIG. 2 shows a side view of an opened pack.
Figure 3:
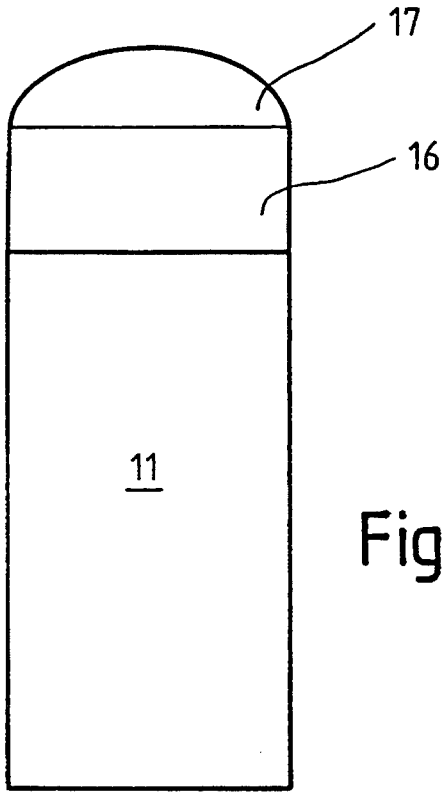
FIG. 3 shows a front view of the opened pack according FIG. 2.

The drawings show, as an advantageous example of use, a cuboid pack 10 with a front wall 11, rear wall 12, narrow side walls 13, 14 and end walls, that is to say a bottom wall 15 and top wall 16. The latter is connected in one piece to the rear wall 12 and, in the opened pack according to FIG. 1, extends in the same plane as the latter. A free end of the top wall 16 is designed as a flap 17. This reaches down onto the front wall 11 when the pack is closed.

Furthermore, the top wall 16 is connected respectively to the side walls 13, 14, specifically via approximately triangular side tabs 18, 19. These taper as far as corner points 20, 21 which are located on the rear side and in which the top wall 16, rear wall 12 and side wall 13 and respectively the top wall 16, rear wall 12 and side wall 14 also butt against one another.

The pack consists of a plastic foil. This is not necessarily provided with prefabricated folding lines. 0n the contrary, the latter are obtained only as a result of the use of the pack and, in the individual instance, are provided in a controlled manner at specific points. The transitions between the individual walls 11. . .16 and tabs 18, 19 are consequently not sharply pronounced and are only shown as (bending) lines in the Figures. For example, the vertical edge 22 between the front wall 11 and side wall 13 is not an edge in the sense of a sharp bend, but rather a logical separation between the side wall and front wall. The same applies to the remaining "edges" which can be seen in the Figures, insofar as nothing different is shown below.

Figure 4:
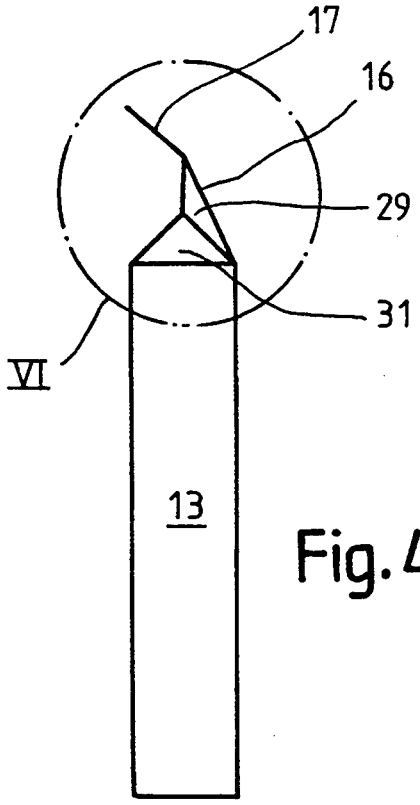
FIG. 4 shows a side view of the pack, similar to that of FIG. 2, but in an intermediate closing position.
Figure 5:
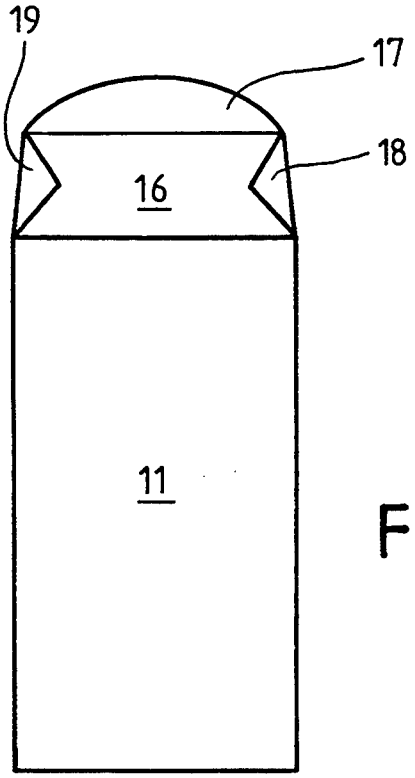
FIG. 5 shows a front view of the pack according to FIG. 4.
Figure 6:
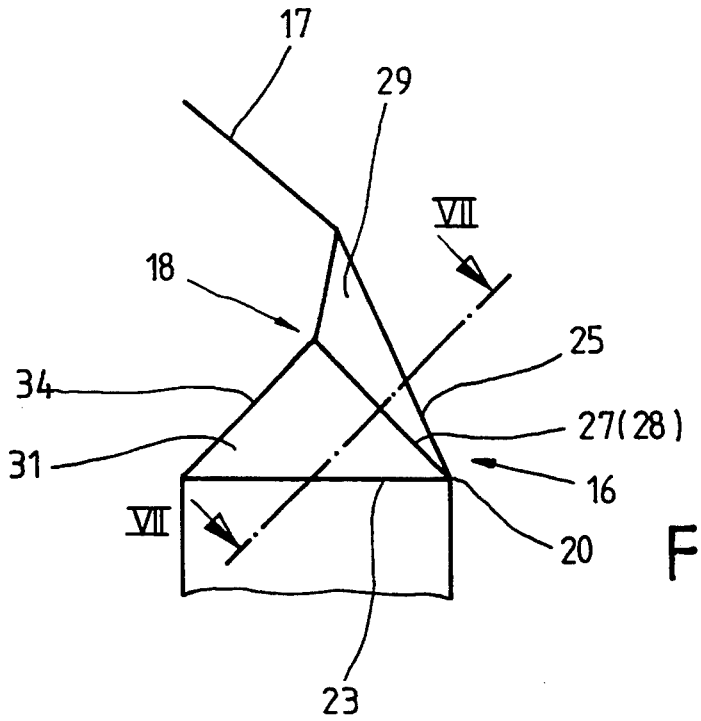
FIG. 6 shows an enlarged representation of the cutout circled in FIG. 4.

FIGS. 2 to 5 illustrate the pack 10 on the one hand in the opened position, similar to FIG. 1, and on the other hand in an intermediate closing position, particularly FIG. 4. In the latter, the top wall 16 is angled forwards slightly out of the plane of the rear wall 12. The flap 17 is angled further once again, and FIG. 6 shows an enlarged representation of this.

In the opening position (FIG. 2), the side tabs are extended. During the closing operation, the side tabs 18, 19 are folded inwards via an intermediate folding position according to FIG. 4 and FIG. 5 or FIG. 6 into a closing position in which the side tabs 18, 19 lie folded underneath the top wall 16. The flap 17 extends in the region of the front wall 11 and can be connected releasably to the latter, for example by means of an adhesive tape.

For the exact folding of the side tabs 18, 19, which are of triangular design here, these are limited and divided by folding lines. Folding lines 23, 24 are predetermined at the transition of the side tabs 18, 19 to the side walls 13, 14, and corresponding folding lines 25, 26 are likewise predetermined at the transition of the side tabs 18, 19 to the top wall 16. Starting from the corner points 20, 21, folding lines 27, 28 run the diagonal direction in order to divide the side tabs 18, 19 respectively into a tab part 29, 30 connected to the top wall 16 and a tab part 31, 32 connected to the side wall 13, 14.

The side tabs 18, 19, triangular here, are to have an exact folding pattern in the closing position, even after the pack has been opened and closed several times. For this purpose, at least the folding lines 27 and 28 are designed in a special way, as shown as a detail particularly in FIG. 7. The side-tab parts (tab part 29 and tab part 31 or 30 and 32) are permanently connected to one another in the region of the folding line 27 or 28, to form a seam 33 of specific width.

The pack is preferably made from a thermoplastic material. The seam 33 is then formed as a sealing or embossing seam by the application of pressure and heat, with a width of approximately 0.5 mm. When the pack is being closed by laying the top wall 16 or flap 17 onto the front wall 11, a neat inward folding of the side tabs 18, 19 is achieved automatically by means of the folding lines 27, 28 or the seam 33. No disturbing outward protrusions and also no undesirable additional folds occur. Even after multiple opening and closing, the pack 10 remains functional and visually attractive in this region.

The seam 33 described can also be provided alternatively or additionally in the region of the folding lines 23. . .26, in the same way as these themselves are arranged alternatively or additionally to the folding lines 27, 28.

A blank provided for forming the pack 10 is made in one piece and is not shown here. The flap 17 has a free edge 35 which is, for example, curved in a circularly convex manner. As a counterpart to this, a free edge 36 of the front wall 11 is made concavely curved. On the blank spread out flat, the edges 34, 35, 36 merge smoothly into one another in the manner of a sinusoidal curve. The resulting edge line (sinusoidal curve) has no kinks or jumps.

Figure 7:
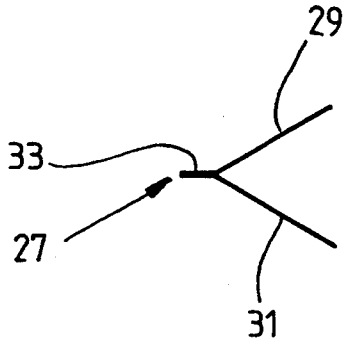
FIG. 7 shows a further-enlarged sectional representation of the pack according to FIG. 6 along the line VII—VII.

The dimensionally stable folding line or embossing seam shown in FIG. 7 can also be produced as a result of the adhesive bonding of the strip-like regions. Alternatively, other shape-modifying treatments of the foil in the region of folding lines are also possible, for example a local stretching of the foils in order to provide a strip-like reduction of material in the region of the folding line.

The folding line described and illustrated in FIG. 7 can also be employed in other shapes and types of packs where stabilized folding lines formed reliably are required.

I claim:

1. A reclosable pack (10) made from plastic foil, comprising a front wall (11), a rear wall (12), and foldable side tabs (18, 19) which, for opening and closing, are foldable along predetermined folding lines (27, 28), the side tabs (18, 19) being subdivided into tab parts (29, 31; 30, 32) by the folding lines (27, 28), wherein regions of the tab parts (29, 31; 30, 32) adjacent to one another in the region of the folding lines (27, 28), for increasing a restoring force in the direction of a closing position of the tab parts (29, 31; 30, 32), are durably connected to one another by bonding.

2. A pack as claimed in claim 1, wherein, to form the folding lines (27, 28), strip-like regions of the tab parts (29, 31; 30, 32), which are adjacent to the folding lines with a width of up to 1 mm, are bonded to one another.

3. A pack as claimed in claim 1, wherein, to form the folding lines (27, 28), strip-like regions of the tab parts (29, 31; 30, 32), which are adjacent to the folding lines with a width of approximately 0.5 mm, are bonded to one another.

4. A reclosable pack (10) made from plastic foil, comprising a front wall (11), a rear wall (12), narrow side walls (13, 14), a bottom wall (15), an upper wall (16), which is adjacent to the rear wall (12) in one piece, and foldable side walls (18, 19) which connect the top wall (16) with the side walls (13, 14) and which, for opening and closing, are foldable along predetermined folding lines (27, 28) which subdivide the side walls (18, 19) into tab parts (29, 31; 30, 32), wherein regions of the tab parts (29, 31; 30, 32) adjacent to one another in the region of the folding lines (27, 28), for increasing a restoring force in the direction of a closing position of the tab parts (29, 31; 30, 32), are durably connected to one another by bonding.

5. A pack as claimed in claim 4, wherein, to form the folding lines (27, 28), strip-like regions of the tab parts (29, 31; 30, 32), which are adjacent to the folding lines with a width of up to 1 mm, are bonded to one another.

6. A pack as claimed in claim 4, wherein one of the tab parts (29, 30) of the side tabs (18, 19) connects the side tabs to the top wall (16), and another of the tab parts (31, 32) of the side tabs (18, 19) connects the side tabs to the side wall (13, 14).

7. A pack as claimed in claim 5, wherein another predetermined folding line (23, 24) is a connecting line between one of the side walls (13, 14) and one of the side tabs (18, 19), and a further predetermined folding line (25, 26) is a connecting line between the top wall (16) and one of the side tabs (18, 19).

8. A pack as claimed in claim 4, wherein, to form the folding lines (27, 28), strip-like regions of the tab parts (29, 31; 30, 32), which are adjacent to the folding lines with a width of approximately 0.5 mm, are bonded to one another.

* * * * *